US010648275B2

(12) United States Patent
Dirocco

(10) Patent No.: US 10,648,275 B2
(45) Date of Patent: May 12, 2020

(54) BALL ENERGIZED FRAC PLUG

(71) Applicant: FORUM US, INC., Houston, TX (US)

(72) Inventor: Robert Dirocco, Humble, TX (US)

(73) Assignee: FORUM US, INC., Houston, TX (US)

( * ) Notice: Subject to any disclaimer, the term of this patent is extended or adjusted under 35 U.S.C. 154(b) by 151 days.

(21) Appl. No.: 15/860,933

(22) Filed: Jan. 3, 2018

(65) Prior Publication Data

US 2019/0203557 A1 Jul. 4, 2019

(51) Int. Cl.

| | |
|---|---|
| ***E21B 33/129*** | (2006.01) |
| ***E21B 33/12*** | (2006.01) |
| ***E21B 33/10*** | (2006.01) |
| ***E21B 33/128*** | (2006.01) |

(52) U.S. Cl.

CPC ..... *E21B 33/129* (2013.01); *E21B 33/1208* (2013.01)

(58) Field of Classification Search

CPC .... E21B 33/12; E21B 33/129; E21B 33/1208; E21B 33/10; E21B 33/1204; E21B 33/124; E21B 33/128

See application file for complete search history.

(56) References Cited

U.S. PATENT DOCUMENTS

| | | | |
|---|---|---|---|
| 2,230,712 | A | 2/1941 | Bendeler et al. |
| 3,343,607 | A | 9/1967 | Current |
| 4,436,150 | A | 3/1984 | Barker |
| 6,167,963 | B1 | 1/2001 | McMahan et al. |
| 6,491,116 | B2 | 12/2002 | Berscheidt et al. |
| 7,735,549 | B1 | 6/2010 | Nish et al. |
| 7,740,079 | B2 | 6/2010 | Clayton et al. |
| 8,079,413 | B2 | 12/2011 | Frazier |
| 8,267,177 | B1 | 9/2012 | Vogel et al. |
| 9,169,704 | B2 | 10/2015 | Dockweiler et al. |
| 9,759,034 | B2 | 9/2017 | King et al. |
| 9,777,551 | B2 | 10/2017 | Davies et al. |
| 9,835,003 | B2 | 12/2017 | Harris et al. |
| 2011/0240295 | A1 | 10/2011 | Porter et al. |
| 2013/0186648 | A1* | 7/2013 | Xu ..... E21B 23/01 166/382 |
| 2016/0305215 | A1 | 10/2016 | Harris et al. |
| 2016/0376869 | A1 | 12/2016 | Rochen et al. |

FOREIGN PATENT DOCUMENTS

| | | | |
|---|---|---|---|
| WO | 2016/028311 | A1 | 2/2016 |

OTHER PUBLICATIONS

International Search Report and Written Opinion dated May 28, 2019, corresponding to Application No. PCT/US2018/064973.

Invitation to Pay Additional Fees dated Apr. 3, 2019 for corresponding International Application No. PCT/US2018/064973.

* cited by examiner

*Primary Examiner* — D. Andrews
*Assistant Examiner* — Manuel C Portocarrero
(74) *Attorney, Agent, or Firm* — Patterson & Sheridan, L.L.P.

(57) ABSTRACT

A frac plug that is energized by a ball member, the frac plug comprising an upper mandrel having a tapered outer surface, a seal member coupled to the upper mandrel, and a lower mandrel coupled to the upper mandrel. A button ring having one or more buttons is disposed about the upper mandrel. The lower mandrel is movable relative to the upper mandrel to move the button ring along the tapered outer surface and force the buttons into gripping contact with a surrounding wellbore. The seal member is movable into sealing contact with the surrounding wellbore by the ball member.

19 Claims, 6 Drawing Sheets

BALL ENERGIZED FRAC PLUG

BACKGROUND

Field

Embodiments disclosed herein relate to non-retrievable frac plugs used to isolate a section of a wellbore in the production of oil and gas.

Description of the Related Art

A fracturing plug or "frac plug" is designed to isolate a section within a wellbore casing and hold pressure within the section above the frac plug. After setting the frac plug, the casing is perforated and the formation surrounding the perforation is fractured using pressurized fluid that is supplied through the casing to stimulate the formation. After fracturing the formation, the perforations in the casing and newly formed fractures in the formation allow the flow of oil and gas to enter the casing and be recovered to the surface. When the operation is complete, the frac plug is drilled out to allow access to the full bore of the casing for subsequent operations.

Frac plugs create a seal inside of the wellbore casing by axially squeezing an "element package" having a seal element located between two members on a body of the frac plug. One drawback of conventional frac plugs is that they require a large axial setting force to "squeeze" the element package, which results in the seal element projecting radially outside the outside diameter of the frac plug to contact the casing. Another drawback is that conventional frac plugs have long axial lengths, which increases that amount of drilling that is needed to drill out the frac plugs to have access to the full bore of the casing as described above.

Therefore, there exists a need for new and/or improved frac plugs.

SUMMARY

In one embodiment, a frac plug that is energized by a ball member comprises an upper mandrel having a tapered outer surface; a seal member coupled to the upper mandrel; a lower mandrel coupled to the upper mandrel; and a button ring having one or more buttons disposed about the upper mandrel, wherein the lower mandrel is movable relative to the upper mandrel to move the button ring along the tapered outer surface and force the buttons into gripping contact with a surrounding wellbore, and wherein the seal member is movable into sealing contact with the surrounding wellbore by the ball member.

In one embodiment, a method of setting a frac plug comprises lowering the frac plug into a wellbore while in an unset position; moving the frac plug into a set position by applying a pull force to the frac plug to move a button ring having one or more buttons radially outward into gripping contact with the wellbore; and moving the frac plug into a set and sealed position by dropping a ball member into the frac plug to move a seal member radially outward into sealing contact with the wellbore.

In one embodiment, a frac plug mandrel comprises an upper end portion having a seal support section; a middle portion having a tapered outer surface, and a ball seat formed about the inner circumference of the mandrel and configured to receive a ball member; and a lower end portion comprising one or more ratchet members having teeth formed on the outer surface of the mandrel.

BRIEF DESCRIPTION OF THE DRAWINGS

To facilitate understanding, identical reference numerals have been used, where possible, to designate identical elements that are common to the figures. It is contemplated that elements disclosed in one embodiment may be beneficially utilized with other embodiments without specific recitation.

DETAILED DESCRIPTION

Embodiments disclosed herein relate to non-retrievable fracturing plugs or "frac plugs" that are configured to isolate a section of a wellbore in the production of oil and gas. The frac plug is energized by a ball member that is dropped into the frac plug. The length of the frac plug is shortened when set in the wellbore.

Figure 1:
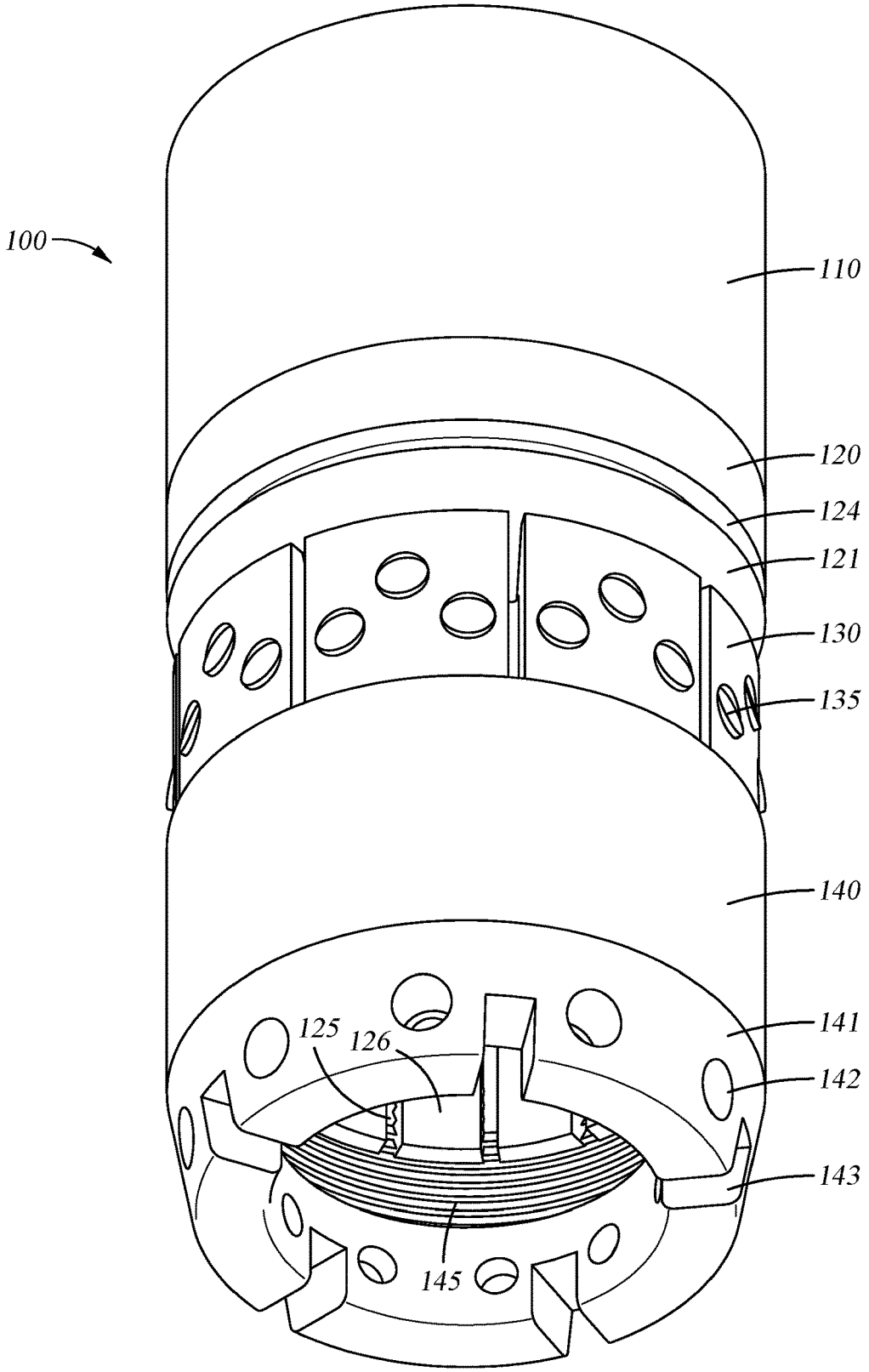
FIG. 1 is an isometric bottom view of a frac plug according to one embodiment.
Figure 2:
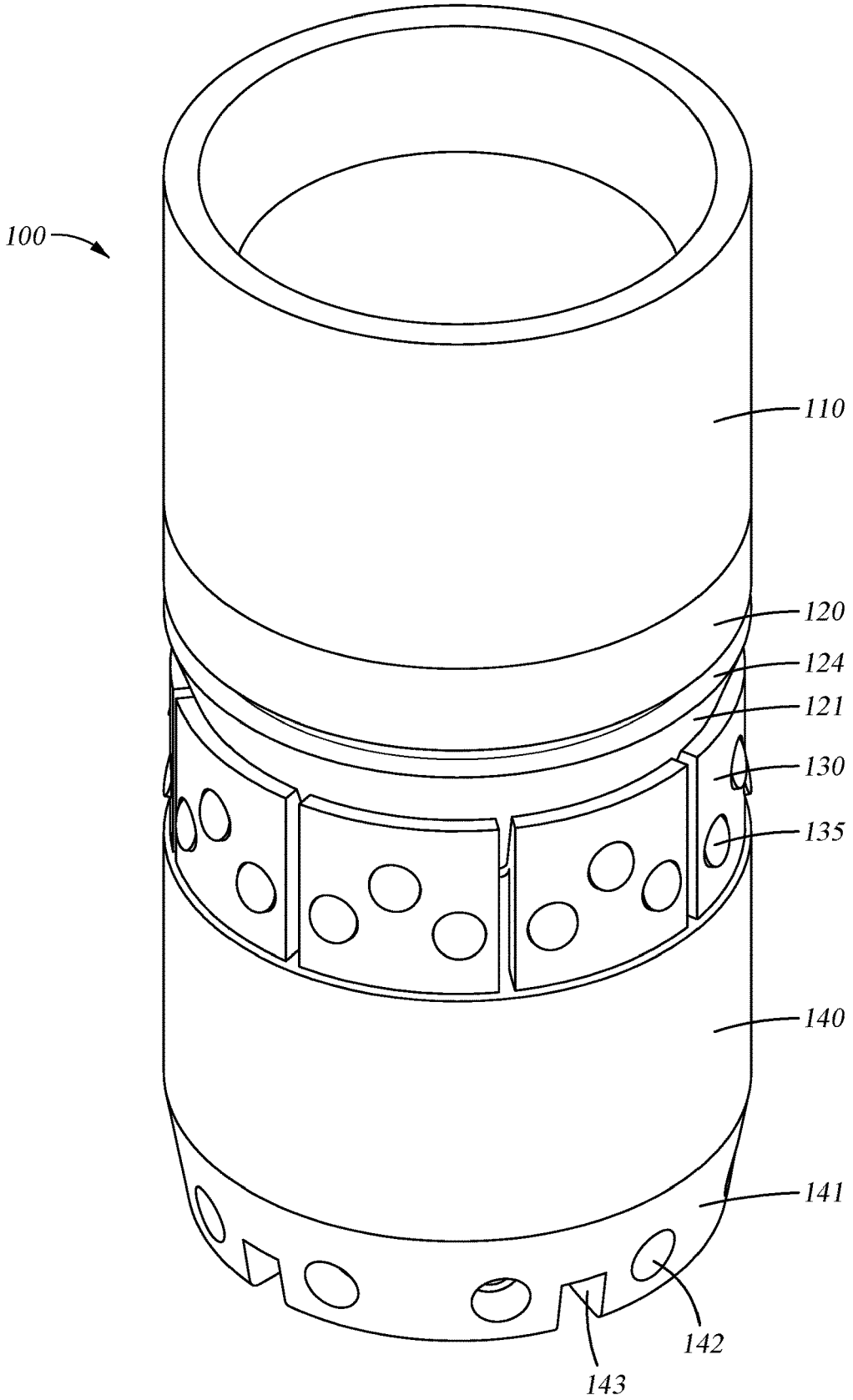
FIG. 2 is an isometric top view of the frac plug according to one embodiment.
Figure 3:
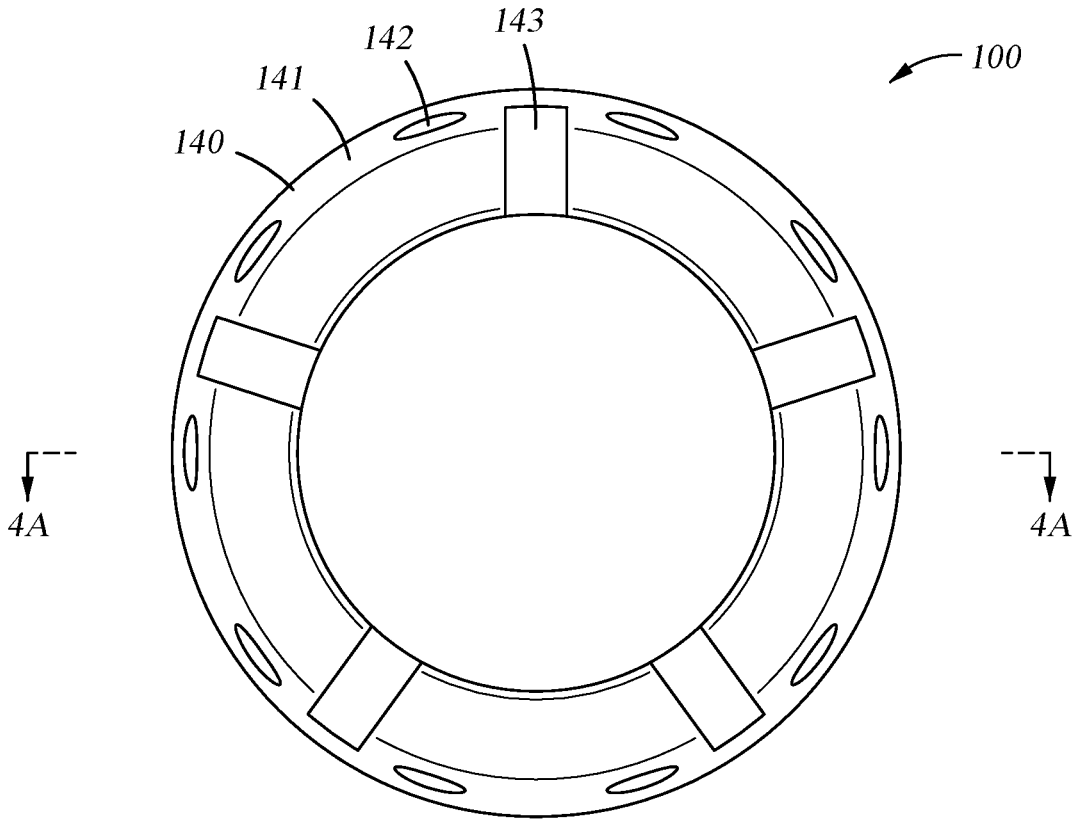
FIG. 3 is a bottom view of the frac plug of FIG. 1 according to one embodiment.

FIG. 1 is an isometric bottom view of a frac plug 100 according to one embodiment. FIG. 2 is an isometric top view of the frac plug 100. FIG. 3 is a bottom view of the frac plug 100.

The frac plug 100 includes a seal member 110 that is coupled to an upper end portion of an upper mandrel 120. The seal member 110 and the upper mandrel 120 may be coupled together by being separate components that are joined together (such as by being molded together) or by being integrally formed together as a single component. The seal member 110 may be formed out of an elastomeric material. The upper mandrel 120 may be formed out of a metallic material. The seal member 110 and the upper mandrel 120 may be made out of the same or different materials.

The upper mandrel 120 is coupled to a lower mandrel 140. The upper mandrel 120 includes one or more ratchet members 126 that couple the upper mandrel 120 to the lower mandrel 140. The ratchet members 126 may form a lower end portion of the upper mandrel 120, and may have teeth 125 that engage teeth 145 formed on the inner surface of the lower mandrel 140. The lower end of the lower mandrel 140 has a tapered outer surface 141 with one or more shear screw holes 142 and one or more channels 143 formed through the lower mandrel 140.

A button ring 130 having one or more buttons 135 is disposed about the upper mandrel 120 and supported on top of the lower mandrel 140. The buttons 135 may be any type of gripping members that can grip and secure the frac plug 100 in a surrounding wellbore. The upper mandrel 120 has a tapered outer surface 121 along which the button ring 130 is moveable to move the buttons 135 outward into gripping contact with a surrounding wellbore as further described below with respect to FIG. 4B. The upper mandrel 120 also has a compliant groove 124 formed about the outer circumference to assist with sealing of the frac plug 100 in a surrounding wellbore as further described below with respect to FIG. 4C.

The tapered outer surface 121 and the compliant groove 124 may be formed within a middle portion of the upper mandrel 120, such as between the upper end portion and the lower end portion of the upper mandrel 120. The compliant groove 124 may be located above the tapered outer surface 121.

Figure 4A:
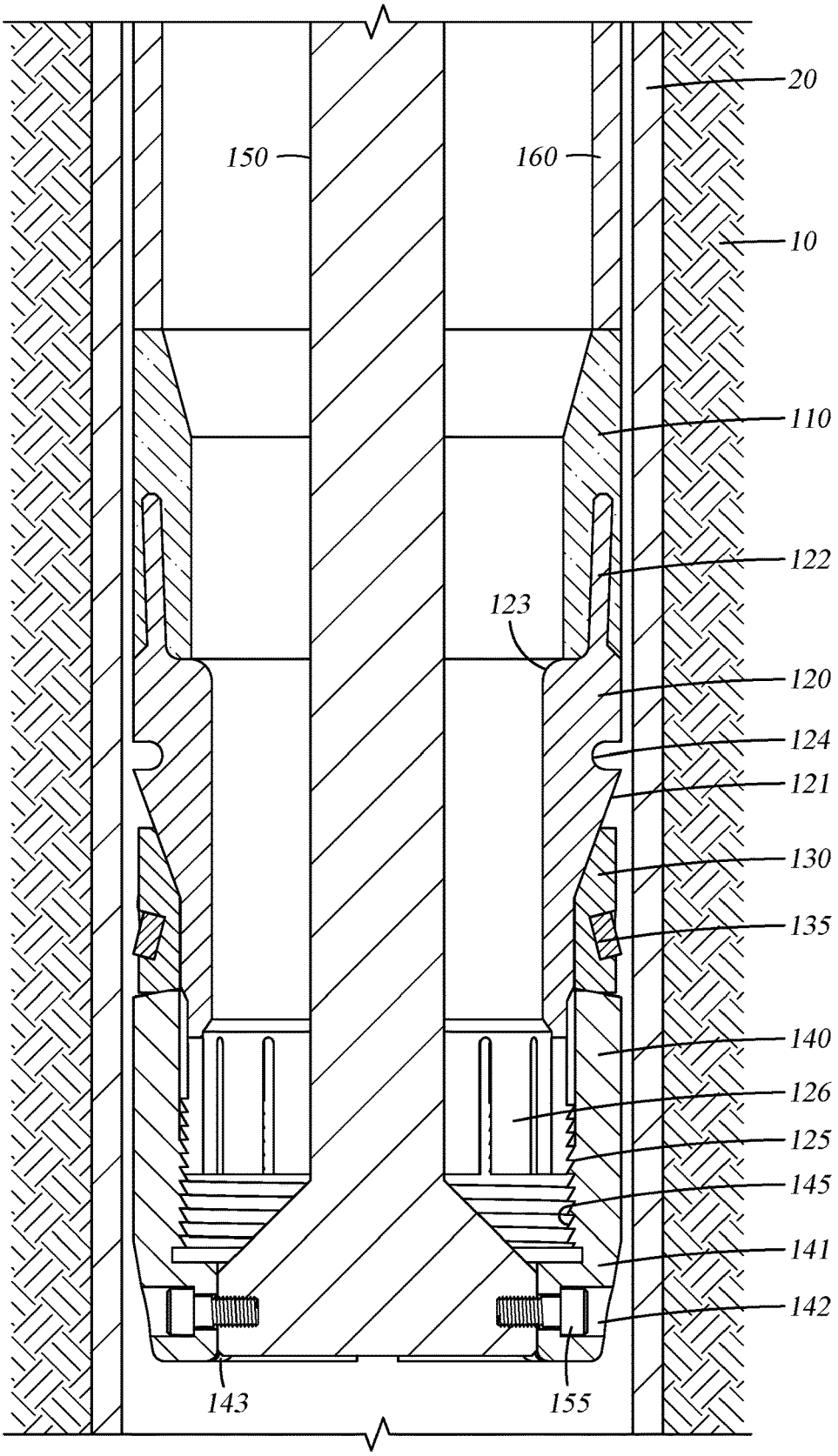
FIG. 4A is a sectional view of the frac plug taken along lines 4A-4A of FIG. 3 illustrating an unset position of the frac plug according to one embodiment.
Figure 4B:
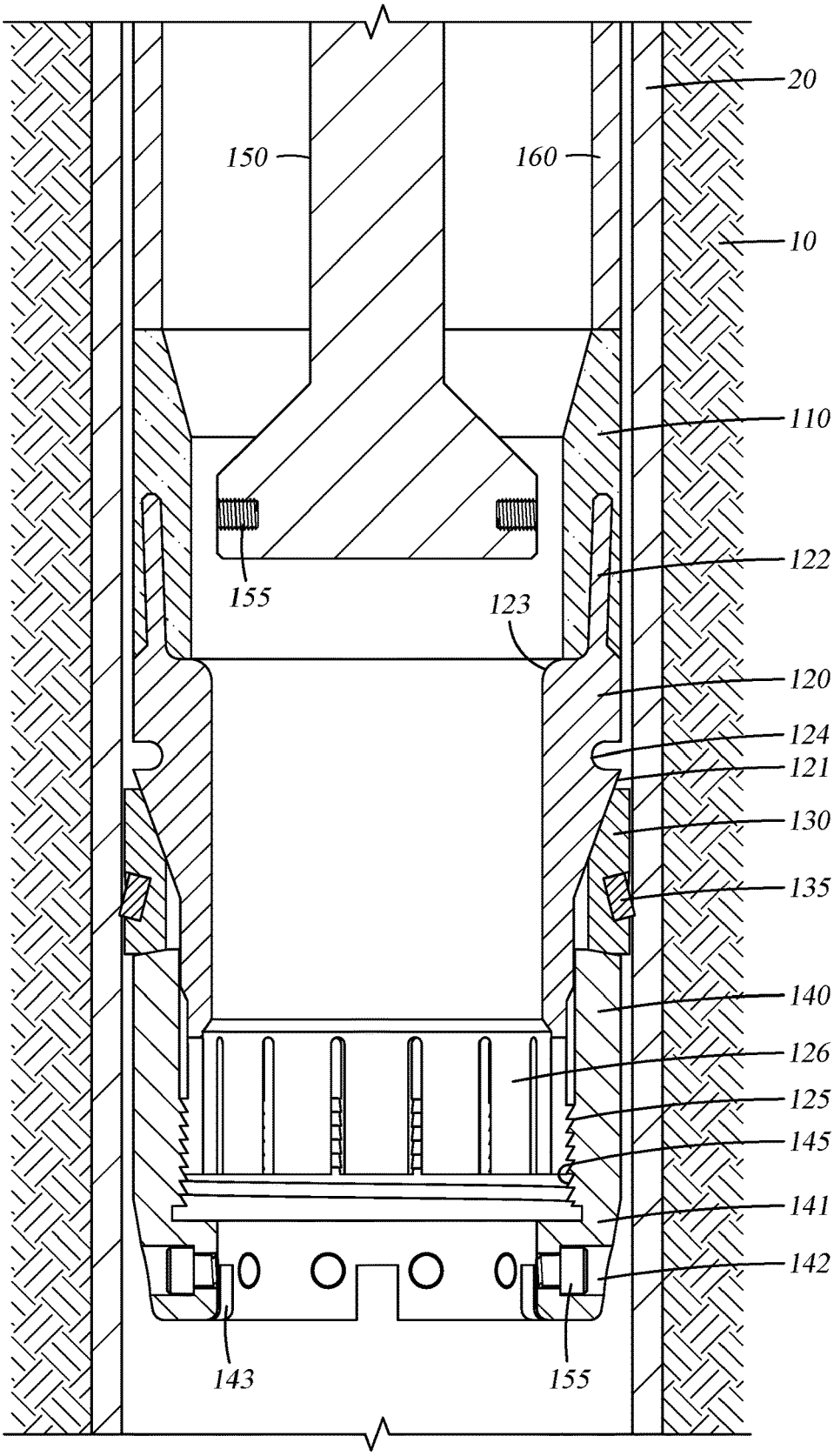
FIG. 4B is a sectional view of the frac plug taken along lines 4A-4A of FIG. 3 illustrating a set position of the frac plug according to one embodiment.

FIG. 4A is a sectional view of the frac plug 100 taken along lines 4A-4A of FIG. 3 illustrating an unset position of the frac plug 100. The frac plug 100 is lowered into a wellbore 10 by a setting tool (only a portion of which is shown in FIGS. 4A and 4B), which setting tool includes an outer sleeve 160 that contacts the top of the frac plug 100, and an inner rod 150 that is coupled to the lower mandrel 140. The wellbore 10 is cased with a wellbore casing 20, but the frac plug 100 can be used in an uncased, open hole wellbore.

One or more shear screws 155 are disposed through the shear screw holes 142 of the lower mandrel 140 and threaded into the inner rod 150 to couple the frac plug 100 to the setting tool. Fluid can flow into and out of the inner bore of the frac plug 100 as it is lowered through the casing 20. For example, fluid can flow through the channels 143 formed in the lower mandrel 140 to flow around the inner rod 150.

The upper mandrel 120 includes a ball seat 123 in the form of a shoulder formed about the inner circumference of the upper mandrel 120. The ball seat 123 may be located within the middle portion of the upper mandrel 120, such as between the upper end portion and the lower end portion of the upper mandrel 120. The ball seat 123 is configured to receive a ball member 200 (as shown in FIG. 4C), which may be made from a composite material and dropped onto the ball seat 123 to prevent fluid from flowing through the frac plug 100 when needed.

Figure 4C:
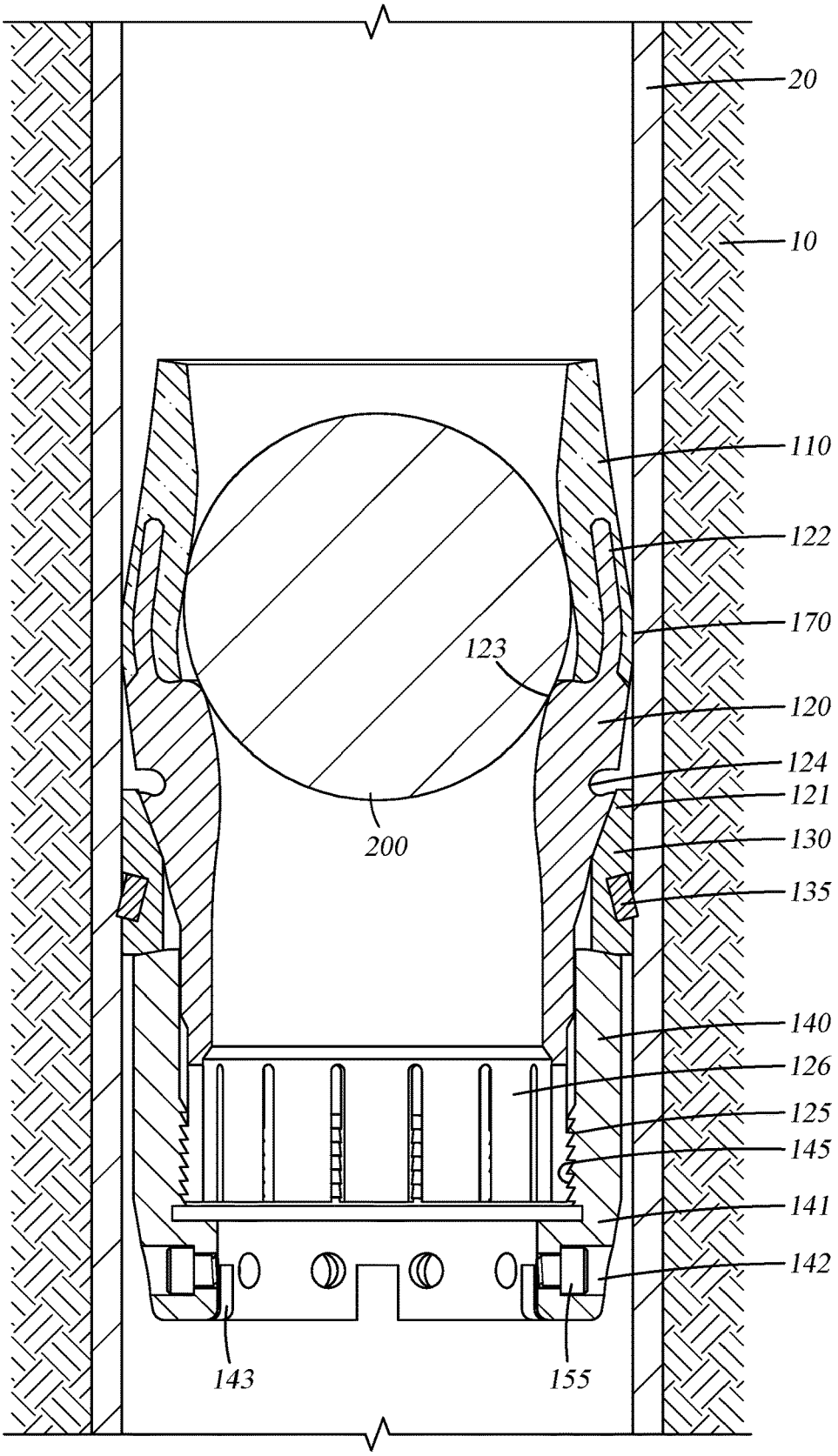
FIG. 4C is a sectional view of the frac plug taken along lines 4A-4A of FIG. 3 illustrating a set and sealed position of the frac plug according to one embodiment.

The upper mandrel 120 may also include a seal support section 122 about which the seal member 110 is formed, such as by being molded, to help contain and prevent extrusion of the seal member 110 when expanded as further shown in FIG. 4C. The seal support section 122 may be in the form of an upper end portion of the upper mandrel 120. The seal support section 122 may have an outer diameter that is less than an outer diameter of at least a portion of the middle portion of the upper mandrel 120. The seal support section 122 may have an inner diameter that is greater than an inner diameter of at least a portion of the middle portion of the upper mandrel 120, such as the ball seat 123. The seal member 110 may be coupled to the seal support section 122 such that the seal member 110 extends above and is at least partially disposed on the inner and outer surfaces of the seal support section 122.

FIG. 4B is a sectional view of the frac plug taken along lines 4A-4A of FIG. 3 illustrating a set position of the frac plug 100. A pull force is applied by the inner rod 150 to the lower mandrel 140 to set the frac plug 100 in the casing 20. The pull force applied by the inner rod 150 pulls the lower mandrel 140 upward relative to the upper mandrel 120 and the seal member 110, which are held in place by the outer sleeve 160. The movement of the lower mandrel 140 moves the button ring 130 up along the outer tapered surface 121 of the upper mandrel 120, which forces the button ring 130 and the buttons 135 radially outward into gripping contact with the casing 20 to secure the frac plug 100 in the casing 20. The buttons 135 are oriented at an angle relative to the longitudinal axis of the casing 20 so that they can grip the casing 20 and prevent the frac plug 100 from moving downward relative to the casing 20 when the frac plug 100 is in the set position.

The frac plug 100 is also held in the set position by the engagement between the teeth 125 formed on the outer surface of the ratchet members 126 and the teeth 145 formed on the inner surface of the lower mandrel 140. The teeth 125, 145 are oriented to allow movement of the lower mandrel 140 relative to the upper mandrel 120 in one direction (e.g. upward), and prevent or minimize movement in the opposite direction (e.g. downward). Although shown as a ratchet-type mechanism, other types of directional control mechanisms, such as a friction or interference fit, can be used control the movement of the lower mandrel 140 relative to the upper mandrel 120.

The length of the frac-plug 100 when in the set position as shown in FIG. 4B is shorter than the length of the frac-plug 100 when in the unset position as shown in FIG. 4A. This shortened length results in less time needed to drill out the frac plug 100 to have full bore access to the casing 20 when desired, such as after the completion of a fracturing and/or stimulation operation as known in the art.

After the frac plug 100 is set and secured within the casing 20, the pull force is continued to be applied by the inner rod 150 until the shear screws 155 shear, which releases the inner rod 150 from the frac-plug 100. The setting tool including the inner rod 150 and the outer sleeve 160 can then be removed from the wellbore 10. Fluid can flow through the full open bore of the frac plug 100, as well as around the outside of the frac plug 100, while it is in the set position.

FIG. 4C is a sectional view of the frac plug 100 taken along lines 4A-4A of FIG. 3 illustrating a set and sealed position of the frac plug 100 according to one embodiment. When it is desired to close fluid through and around the frac plug 100, such as to conduct a fracturing and/or stimulation operation in the wellbore 10 at a location above the frac plug 100, a ball member 200 is dropped into the frac plug 100 and lands on the ball seat 123. The ball member 200 can be in the form of a sphere, a plug, or a dart. The ball member 200 has an outer diameter that is greater than the inner diameter of the seal member 110 and is forced into the inner diameter of the seal member 110 by pressurized fluid flowing behind the ball member 200.

The ball member 200 blocks fluid flow through the inner bore of the frac plug 100 and forms a seal with inner circumference of the seal member 110 and/or with the ball seat 123. The ball member 200 also energizes the seal member 110 by directly forcing and moving the seal member 110 radially outward into sealing contact with the casing 20 as indicated by reference numeral 170 to prevent fluid flow around the outside of the frac plug 100. A portion of the upper mandrel 120, and in particular the seal support section 122, is bent radially outward with the seal member 110 and helps prevent extrusion of the seal member 110 from the upper mandrel 120 when expanded and when pressure above the frac plug 100 is increased.

The compliant groove 124 helps the upper mandrel 120 to comply and be bent radially outward with the seal member 110 without completely shearing or destroying the upper mandrel 120. The ball member 200 may push the upper mandrel 120 slightly downward relative to the button ring 130 and the lower mandrel 140, which further forces the buttons 135 into gripping contact with the casing 20. If enough pressure is applied, the ball member 200 can force at least a portion of the upper mandrel 120 radially outward into sealing contact with the casing 10 to form a metal-to-metal seal. Pressure within the casing 20 above the frac plug 100 can be further increased and maintained by the frac plug 100 from below. When desired, the ball member 200 and the frac plug 100 can be drilled out to re-establish full bore access through the casing 20.

In one embodiment, the ball member 200 and the frac plug 100, specifically the seal member 110, the upper mandrel 120, the button ring 130, the buttons 135, and/or the lower mandrel 140, can be formed out of drillable materials such as composite materials, plastics, rubbers, and fiberglass. In one embodiment, the composite material may include a carbon fiber reinforced material or other material that has high strength yet is easily drillable. In one embodiment, the seal member 110 can be formed out of rubber that can withstand high temperatures, such as hydrogenated nitrile butadiene rubber (HNBR), or other suitable polymeric material. In one embodiment, the seal member 110 has a hardness of about 80 on the Shore D scale, and withstands temperatures of about 300 degrees Fahrenheit.

In one embodiment, a method of setting and sealing the frac plug 100 in the wellbore 10 comprises lowering the frac plug 100 into the wellbore 10 while in the unset position (as shown in FIG. 4A) to a desired location. The frac plug 100 is lowered by a setting tool having the outer sleeve 160 and the inner rod 150.

The method then comprises moving the frac plug 100 into the set position (as shown in FIG. 4B) by applying a pull force to the frac plug 100 to move the button ring 130 and the buttons 135 radially outward into gripping contact with the wellbore 10. The pull force is applied by the inner rod 150 of the setting tool and pulls against the outer sleeve 160 of the setting tool, which remains stationary and holds the seal member 110 and the upper mandrel 120 in place. The pull force is applied to the lower mandrel 140 to move the lower mandrel 140 relative to the upper mandrel 120, which moves the button ring 130 along the tapered outer surface 121 of the upper mandrel 120 and forces the buttons 135 radially outward into gripping contact with the wellbore 10. The setting tool can then be removed from the wellbore 10.

The method then comprises moving the frac plug 100 into a set and sealed position (as shown in FIG. 4C) by dropping the ball member 200 into the frac plug 100 to move the seal member 110 radially outward into sealing contact with the wellbore 10. The ball member 200 forces both the seal member 110 and the seal support section 122 (e.g. the upper end portion of the upper mandrel 120) radially outward toward the wellbore 10. If enough pressure is applied, the ball member 200 can force at least a portion of the upper mandrel 120 radially outward into sealing contact with the wellbore 10, such as to form a metal-to-metal seal if the upper mandrel 120 is formed out of a metallic material and the wellbore 10 is cased with the casing 20.

The length of the frac plug 100 when in the set position is shorter than the length of the frac plug 100 when in the unset position. Fluid can flow through and around the frac plug 100 when in the set position. Fluid cannot flow through and around the frac plug 100 when in the set and sealed position. Pressure within the wellbore 10 above the frac plug 100 when in the set and sealed position can be further increased to conduct a fracturing and/or stimulation operation as known in the art. Subsequently, the ball member 200 and the frac plug 100 can be drilled out to re-establish full bore access to the wellbore 10.

While the foregoing is directed to embodiments of the disclosure, other and further embodiments of the disclosure thus may be devised without departing from the basic scope thereof, and the scope thereof is determined by the claims that follow.

The invention claimed is:

1. A frac plug that is energized by a ball member, comprising;

an upper mandrel having a tapered outer surface and an upper end portion, the upper end portion forming a seal support section;

a seal member formed about the seal support section of the upper mandrel to at least partially contain extrusion of the seal member when the seal member moves, wherein the seal member is coupled to the seal support section such that the seal member extends above and is at least partially disposed on an inner surface and an outer surface of the seal support section;

a lower mandrel coupled to the upper mandrel; and a button ring having one or more buttons disposed about the upper mandrel, wherein the lower mandrel is movable relative to the upper mandrel to move the button ring along the tapered outer surface and force the buttons into gripping contact with an inner surface of a surrounding wellbore, and wherein the seal member is movable into sealing contact with the inner surface of the surrounding wellbore by the ball member.

2. The frac plug of claim 1, wherein the seal member is molded about the seal support section.

3. The frac plug of claim 1, wherein the upper mandrel has one or more ratchet members having teeth that engage teeth formed on the inner surface of the lower mandrel.

4. The frac plug of claim 3, wherein the teeth are oriented relative to each other to allow the lower mandrel to move relative to the upper mandrel in one direction and prevent or minimize movement in an opposite direction.

5. The frac plug of claim 1, wherein a length of the frac plug when in a set position is shorter than a length of the frac plug when in an unset position.

6. The frac plug of claim 5, wherein the buttons are in gripping contact with the inner surface of the surrounding wellbore when the frac plug is in the set position, and wherein the buttons are not in gripping contact with the inner surface of the surrounding wellbore when the frac plug is in the unset position.

7. The frac plug of claim 6, wherein fluid can flow through and around the frac plug when in the set position, fluid is blocked from flowing through the frac plug by the ball member when in a set and sealed position, fluid is blocked from flowing around the frac plug by the seal member when in the set and sealed position, and the seal support section is bent radially outward when the frac plug is in the set and sealed position.

8. The frac plug of claim 1, wherein a compliant groove is formed about an outer circumference of the upper mandrel.

9. The frac plug of claim 1, wherein a ball seat is formed about an inner circumference of the upper mandrel and configured to receive the ball member.

10. A method of setting a frac plug, comprising:

lowering the frac plug into a wellbore while in an unset position, the frac plug having an upper mandrel, the upper mandrel having a seal support section;

moving the frac plug into a set position by applying a pull force to the frac plug to move a button ring having one or more buttons radially outward into gripping contact with an inner surface of the wellbore, wherein in the set position the one or more buttons are in gripping contact with the inner surface of the wellbore, and wherein in the set position a gap is disposed between a seal member and the inner surface of the wellbore, wherein the seal member is coupled to the seal support section such that the seal member extends above and is at least partially disposed on an inner surface and an outer surface of the seal support section; and moving the frac plug into a set and sealed position by dropping a ball member into the frac plug to move the seal member radially outward into sealing contact with the inner surface of the wellbore to seal the gap between the seal member and the inner surface of the wellbore.

11. The method of claim 10, wherein a length of the frac plug when in the set position is shorter than a length of the frac plug when in the unset position.

12. The method of claim 10, further comprising flowing fluid through and around the frac plug when in the set position.

13. The method of claim 10, further comprising preventing fluid flow through the frac plug using the ball member when in the set and sealed position, and preventing fluid flow around the frac plug using the seal member when in the set and sealed position.

14. The method of claim 10, further comprising applying the pull force to a lower mandrel, and moving the lower mandrel relative to the upper mandrel to move the button ring along a tapered outer surface of the upper mandrel, which forces the buttons radially outward into gripping contact with the inner surface of the wellbore.

15. A frac plug mandrel, comprising:

an upper end portion having a seal support section and a seal member formed about the seal support section, wherein the seal member is coupled to the seal support section such that the seal member extends above and is at least partially disposed on an inner surface and an outer surface of the seal support section, and the seal support section is movable to bend radially outward;

a middle portion having a tapered outer surface, and a ball seat formed about an inner circumference of the frac plug mandrel and configured to receive a ball member; and a lower end portion comprising one or more ratchet members having teeth formed on an outer surface of the frac plug mandrel.

16. The frac plug mandrel of claim 15, wherein the seal support section has an outer diameter that is less than an outer diameter of at least a portion of the middle portion.

17. The frac plug mandrel of claim 16, wherein the seal support section has an inner diameter that is greater than an inner diameter of at least a portion of the middle portion.

18. The frac plug mandrel of claim 17, wherein the middle portion has a compliant groove formed about an outer circumference of the frac plug mandrel.

19. The frac plug mandrel of claim 18, wherein the compliant groove is located above the tapered outer surface.

* * * * *